US005669487A

United States Patent [19]

Sakata

[11] Patent Number: 5,669,487

[45] Date of Patent: Sep. 23, 1997

[54] KEY TOP MOUNTING STRUCTURE FOR A VEHICULAR SWITCH

[75] Inventor: Masashi Sakata, Furukawa, Japan

[73] Assignee: Alps Electric Co., Ltd., Tokyo, Japan

[21] Appl. No.: 667,572

[22] Filed: Jun. 21, 1996

[30] Foreign Application Priority Data

Jun. 23, 1995 [JP] Japan ..... 7-181114

[51] Int. Cl.[6] ..... H01H 3/00

[52] U.S. Cl. ..... 200/339; 200/558; 200/553

[58] Field of Search ..... 200/339, 553, 200/554, 555, 556, 557, 558, 559, 560, 561, 562, 563

[56] References Cited

U.S. PATENT DOCUMENTS

| | | | |
|---|---|---|---|
| 4,230,917 | 10/1980 | Osika | 200/339 |
| 4,440,994 | 4/1984 | Nat | 200/339 |
| 4,767,895 | 8/1988 | Parrish | 200/339 |
| 5,066,842 | 11/1991 | Yamagata et al. | 200/345 |

*Primary Examiner*—David J. Walczak

*Attorney, Agent, or Firm*—Guy W. Shoup; Patrick T. Bever

[57] ABSTRACT

A key top mounting structure for connecting a key top to an operating lever of, for example, a power window control switch of a vehicle. The key top mounting structure provides a precise switch operating mechanism which can be used in both a push-push type and a push-pull type switch, thereby reducing production costs by providing component parts common to a variety of key top shapes. The key top mounting structure according to the present invention is provided with an operating lever having an opening surrounded by an upper wall and a pivot shaft for attaching the operating member to a switch body, and a key top having an engaging protrusion and a frame member surrounding the engaging protrusion and spaced therefrom by a gap having a predetermined width. When the key top is mounted to the operating lever, the engaging protrusion is received in the opening and the frame member surrounds the upper wall of the operating lever, thereby securely holding the operating lever between the frame member and the engaging protrusion.

2 Claims, 4 Drawing Sheets

KEY TOP MOUNTING STRUCTURE FOR A VEHICULAR SWITCH

BACKGROUND OF THE INVENTION

The present invention relates to a key top mounting structure for mounting a key top onto a switch body, and more particularly to a key top mounting structure for securely connecting a key top to a push-pull type vehicle power window control switch.

FIGS. 5A and 5B show a conventional key top mounting structure which is used to mount a resinous key top 12 to a vehicular power window control switch. The conventional key top mounting structure includes an operating lever 10 and the resinous key top 12. The operating lever 10 includes a pivot shaft 9 which is connectable to a switch body (not shown) such that the operating lever 10 is pivotable about the pivot shaft 9. The operating lever 10 also includes a pair of projections (hooks) 13 which are located on opposite side faces adjacent an upper edge of the operating lever 10. The key top 12 includes a hollow base which is mounted over the upper edge of the operating lever 10 such that the upper edge is received within the hollow base of the key top 12. The key top 12 also includes a pair of holes 11 which are formed on opposing side walls near a lower edge of the hollow base. When the key top 12 is mounted on the operating lever 10, the projections 13 are snap-coupled into the holes 11 to fasten the key top 12 to the operating lever 10.

Operation of a push-push type switch using the conventional key top mounting structure is described with reference to FIG. 6. When the key top 12 is pressed (pushed) in the direction of arrow A from a neutral position, the operating lever 10 (which is fastened to the key top 12) is tilted clockwise around the pivot shaft 9. As the operating lever 10 is tilted, a first movable contact piece located at a lower end of the operating lever 10 is pressed into contact with a first fixed contact attached to the switch body, thereby providing a first contact state. This first contact state may be used, for example, to control a window opening operation. Conversely, when the key top 12 is pushed in the direction of arrow B, the operating lever 10 is tilted counter-clockwise around the pivot shaft 9, and a second movable contact piece located at the lower end of the operating lever 10 is pressed into contact with a second fixed contact attached to the switch body, whereby a second contact state is achieved which may be used, for example, to perform a window closing operation.

As mentioned above, power window switches typically include a switch body, which performs the switching function, and a key top structure, which is manipulated by a passenger to control the switching function. The switch body is typically hidden within, for example, a door console. Conversely, the key top structure is exposed for viewing by the passenger and includes symbols or words indicating the function performed by the underlying switch. Recently, key tops having various shapes have become available, and, in addition, various additional types of switches have become available including a pushing type, a pulling type, and a combination thereof, which correspond to the available key top shapes.

In order for switch manufacturers to supply various key tops and various switch bodies while keeping manufacturing costs low, it is desirable to produce key top components which can be interchangeably used with various switch bodies. For example, it is desirable to produce a key top mounting structure which can be used in both push-push and push-pull type switches.

When the above conventional key top mounting structure is subjected to a pushing force applied in the direction of arrow A or B (that is, in the direction in which the key top 12 is mounted on the operating lever 10), the key top 12 remains fastened to the operating lever 10, and a normal switching operation is performed. However, if the key top 12 is used in a push-pull type switch, wherein a pulling force is applied to the key top 12 in the direction of arrow C (that is, in a direction opposite to the mounting direction), because the projections 13 are merely snapped in the holes 11, a large rotational moment is applied to the key top 12 in an upward direction, thereby causing the key top 12 to disengage from the operating lever 10. As such, it is not desirable to use the conventional key top mounting structure in a push-pull type power window switch. Therefore, it is necessary for a switch manufacturer to produce a separate key top mounting structure for push-pull type switches, thereby increasing manufacturing costs.

SUMMARY OF THE INVENTION

The present invention addresses the above-mentioned problems associated with the conventional key top mounting structure. That is, it is an object of the present invention to provide a key top mounting structure which remains securely fastened when used in either a push-push type switch or a push-pull type switch. It is another object of the invention to provide a key top structure which permits component parts thereof to commonly used in various switches, thereby reducing production costs by minimizing the number of different parts which must be produced.

In accordance with the present invention, a key top mounting structure for connecting a key top to a switch body includes an operating lever having an upper wall structure including an opening, and a pivot shaft which is supported by a switch body. The key top is integrally formed with a central engaging protrusion, and a frame member surrounding the engaging protrusion such that a gap having a predetermined thickness is formed between an outer surface of the engaging protrusion and an inner surface of the frame member. When the key top is mounted on the operating lever, the upper wall of the operating lever is received and held in the gap formed between the frame member and the engaging protrusion.

In accordance with the present invention, because the upper wall of the operating lever is held between the frame member and the engaging protrusion, a rotational moment caused by a pulling force applied to the key top is not concentrated solely on a pair of projections, as in the conventional key top mounting structure described above. Instead, the rotational moment is distributed across the entire engaged surface of the key top and operating lever.

When the operation lever is connected to a switch body and the key top is pressed on a front or back portion thereof, the operating lever is tilted about the pivot shaft. A driving rod formed at a lower end of the operating lever moves along a movable contact piece in response to the tilting movement, thereby causing the movable contact piece to make contact with a fixed contact portion formed on the switch body.

Conversely, when a pulling force is applied to the key top, the resulting rotational moment is distributed over the entire engagement structure formed by the engaging protrusion of the key top received in the opening formed at the upper wall of the operating lever, and the upper wall of the operating lever received within the frame member, thereby forming a secure engagement structure so that the key top and the operating lever move integrally with each other. Therefore, the operating lever turns about the pivot shaft and the movable contact piece contacts the fixed contact portion mounted on the switch body.

DESCRIPTION OF THE PREFERRED EMBODIMENT

An embodiment of the present invention is described below with reference to FIGS. 1 though 4.

Figure 1:
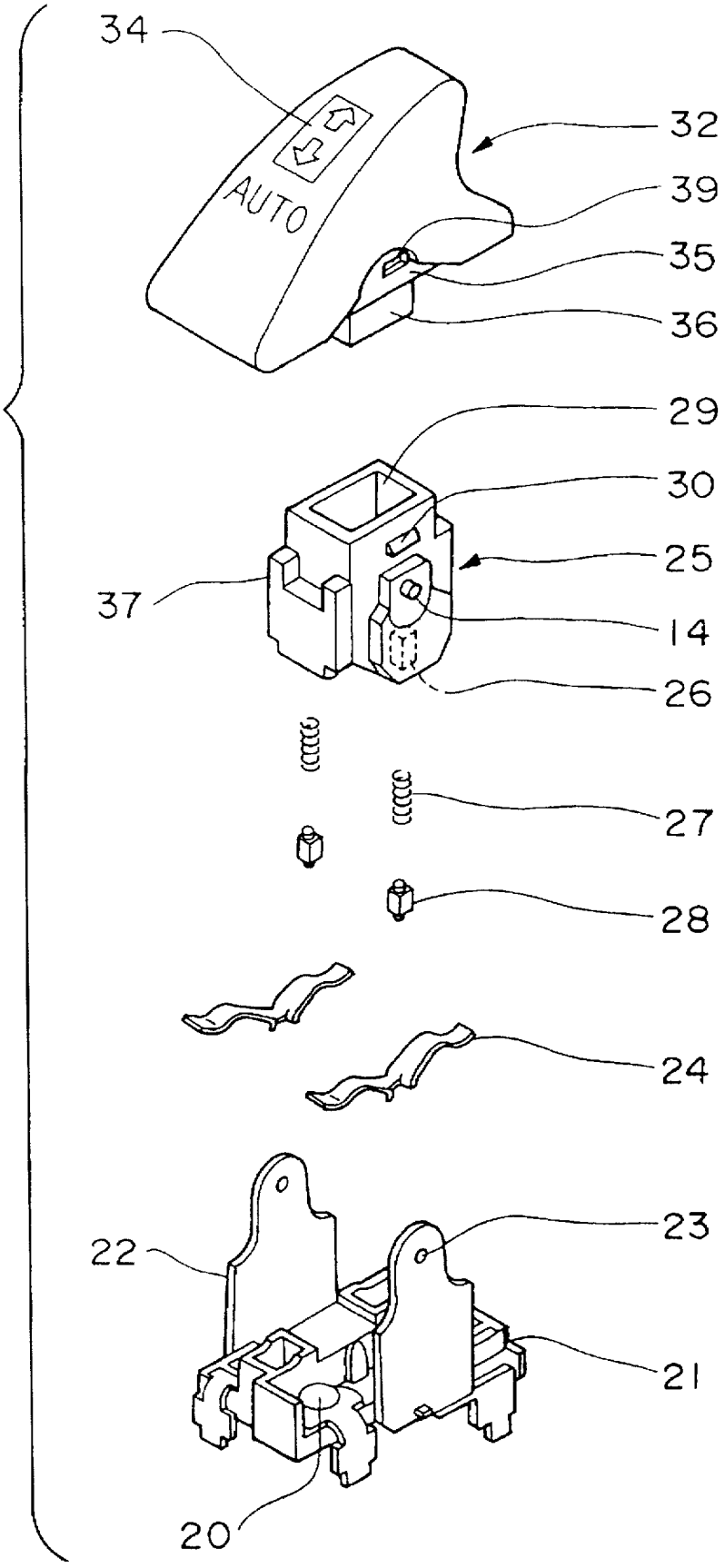
FIG. 1 is an exploded perspective view showing a vehicular switch incorporating a key top mounting structure according to an embodiment of the present invention.

FIG. 1 is an exploded perspective view showing a vehicle power window switch incorporating the key top mounting structure according to the present invention. The power window switch includes a switch body for pivotally supporting the key top mounting structure.

Referring to the lower portion of FIG. 1, the switch body includes a base (wafer) 21 which is integrally formed with two holding arms 22. The holding arms 22 are erected on opposite sides of the base 21, and each of the holding arms includes a pivot hole 23 formed near the upper end thereof. In addition, fixed contact portions are provided on an upper surface of the base 21. Movable contact pieces 24, which have a substantially M-shape, are mounted above the fixed contact portions 20. The movable contact pieces 24 are pressed toward the base 21 by the key top mounting structure, as described below.

In accordance with the present invention, the key top mounting structure includes an operating lever 25 and a key top 32.

Figure 2:
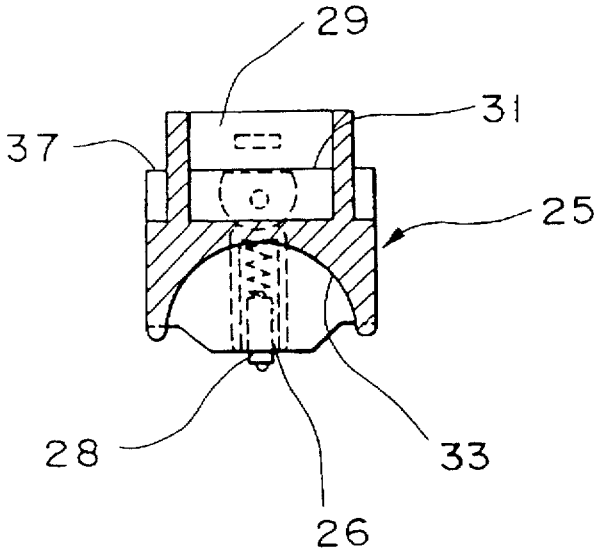
FIG. 2 is a side sectional view showing an operating lever of the key top mounting structure shown in FIG. 1.

The operating lever 25 is mounted above the movable contact pieces 24 and formed of a transparent resin material. The operating lever includes a pivot shaft 14 extending from opposite sides thereof, and is rotatably received in the pivot holes 23. As shown in FIG. 2, holes 26 are formed in the lower ends of the operating lever 25 and a coiled spring 27 is received in each of the holes 26. In addition, driving rods 28 are slidably inserted into the holes 26 such that the driving rods 28 are biased downward (that is, away from the key top 25) by the coil springs 27. When the key top mounting structure is connected to the switch body, the movable contact pieces 24 are continuously pressed against the base 21 by the driving rods 28 through the biasing force of the springs 27. Formed at the upper end of the operating lever 25 is a wall 29 having an opening formed therein, and projections (hooks) 30 formed on an outer surface of the wall 29 adjacent an upper edge thereof. On the inner surface of the wall 29 and near the upper edge are formed (second) stepped portions 31. Further, on the outer surface of the wall 29 are formed (third) stepped portions 37 having upper surfaces which are level (co-planar) with upper surfaces of the stepped portions 31. Finally, a curved surface 33 is formed on the lower end of the operating lever 25 for directing light from a light source located adjacent the switch toward the key top 25, as discussed below.

Figure 3:
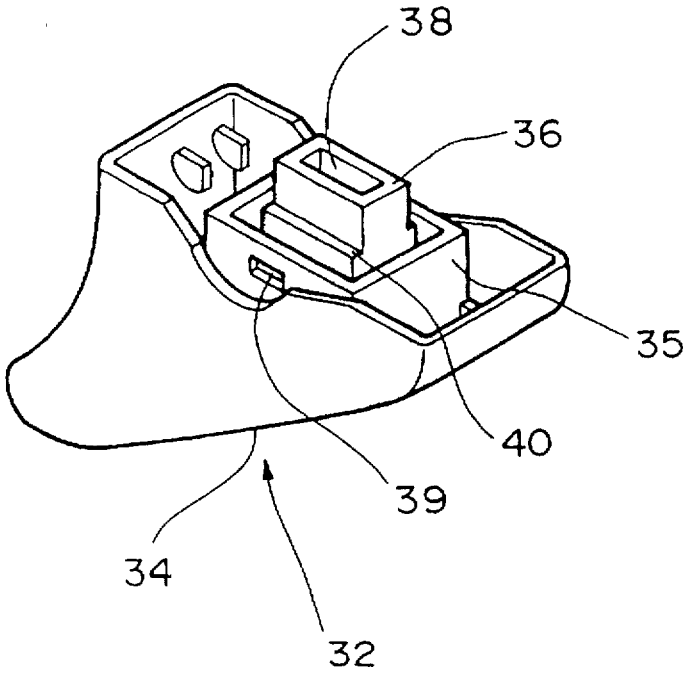
FIG. 3 is a perspective view showing a key top of the key top mounting structure shown in FIG. 1.

FIG. 3 illustrates the key top 32. The key top 32 includes an upper surface 34 which includes a transparent display, a frame member 35 formed on the back side of the upper surface 34, and an engaging protrusion 36. The engaging protrusion 36 is made of a transparent resin material and is surrounded by the frame member 35. On an outer surface of the engaging protrusion 36 are formed (first) stepped portions 40 which extend in a longitudinal direction of the key top 32. The engaging protrusion 36 is shaped to fit snugly within the opening formed in the wall 29 of the operating lever 25. In addition, the engaging protrusion 36 is separated from an inner surface of the frame member 35 by a gap having a width which is equal to a thickness of the wall 29. Further, the interior of the engaging protrusion 36 is hollow, and includes an opening 38 formed at the lower end of the engaging protrusion 36 which serves as a light conduction passage to the transparent display of the upper surface 34 of the key top 32. Finally, holes 39 are formed in the frame member 35 on the same sides as the stepped portions 40.

Figure 4A:
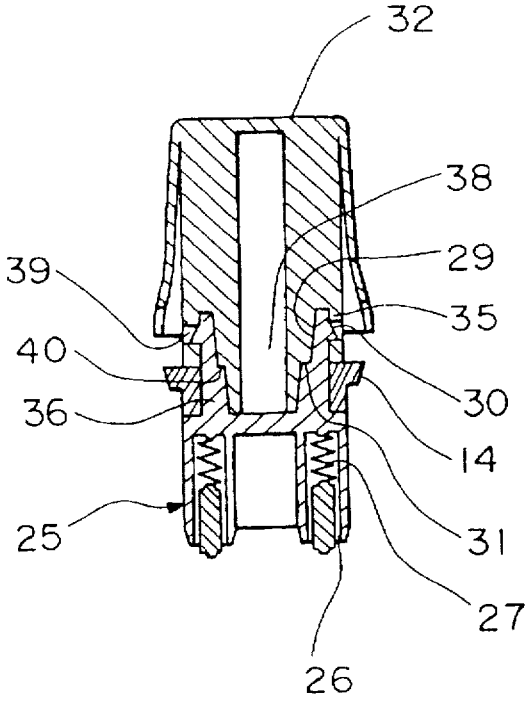
FIG. 4A is a front sectional view taken along line 4A—4A of FIG. 4B, and shows a combined structure including the key top and the operating lever.
Figure 4B:
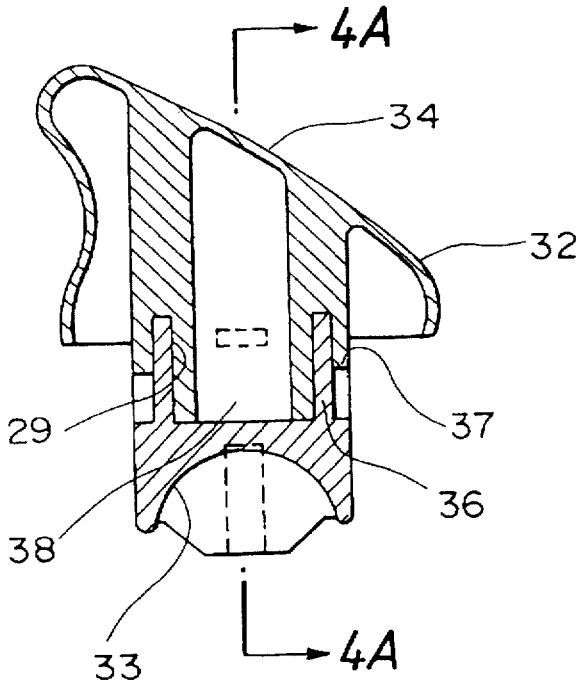
FIG. 4B is a side sectional view showing the combined structure.
Figure 5A:
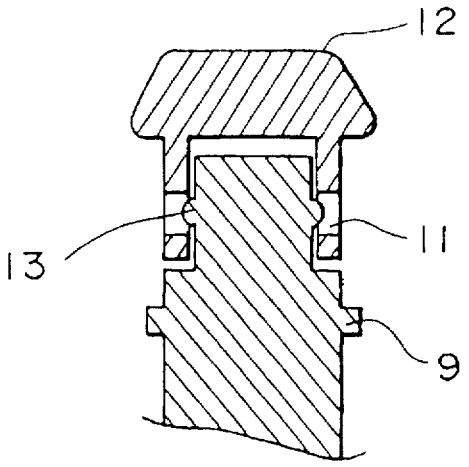
FIG. 5A PRIOR ART
FIG. 5A is a partial vertical sectional view taken sideways on line 5A—5A in FIG. 5B showing a conventional key top mounting structure.
Figure 5B:
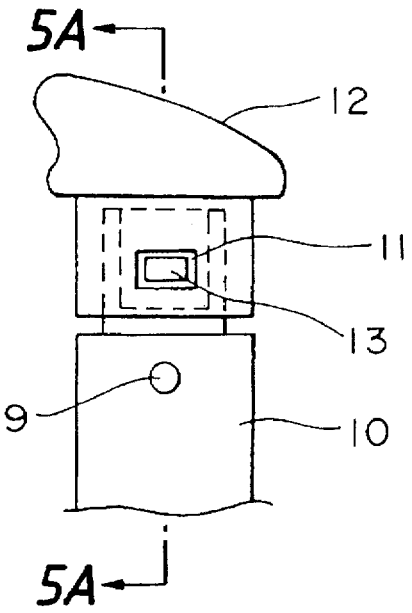
FIG. 5B PRIOR ART
FIG. 5B is a partial front view of the conventional key top mounting structure.

FIGS. 4A and 4B show a combined key top mounting structure formed when the key top 32 is connected to the operating lever 25. The key top 32 is mounted to the wall 29 of the operating lever 25 such that the wall 29 is received in the gap formed between the engaging protrusion 36 and the frame member 35, and the engaging protrusion 36 is received within the opening formed in the wall 29. The projections 30 of the lever 25 are snap-coupled into the holes 39 formed in the frame member 35. In addition, when the key top 32 is fully connected to the operating lever 25, the stepped portions 40 of the key top 32 abut the stepped portions 31 of the operating lever 25, and the stepped portions 37 of the operating lever abut the frame member 35. According to this construction, the entire inner surface of the wall 29 is contacted by the outer surface of the engaging protrusion, and the outer surface is contacted by the inner surface of the frame member 35, thereby tightly holding the wall 29 between the frame member 35 and the engaging protrusion 36. In one embodiment, the engaging protrusion 36 of the key top 32 is formed in a tapered shape (shown in FIG. 4A) which gradually diverges from the upper end of the engaging protrusion 36 toward the lower (free) end thereof. In conformity with this tapered shape, the inner surface of the opening formed in the wall 29 of the operating lever 25 also diverges from its upper edge toward a bottom thereof. It is noted, however, that this tapered shape is optional.

When the key top 32 is mounted onto the operating lever 25, the engaging protrusion 36 is inserted into the opening formed in the wall 29, whereby the lower inner surface of the wall 29 (below the stepped portions 31) is firmly engaged with the outer portion of the engaging protrusion 36 extending from the lower end to the stepped portions 40 without leaving any gap. In this state of engagement, the projections 30 are snap-coupled into the holes 39.

Illumination of the key top 32 will now be described. As shown in FIG. 4B, light from a light source, e.g. an LED disposed adjacent the switch, is reflected upward by the curved surface 33 of the operating lever 25, passes through the operating lever 25 (which is formed of a transparent resin), further passes through the open end 38 of the key top 32, and illuminates the transparent display formed in the upper surface 34 of the key top 32.

Operation of the switch incorporating the key top mounting structure according to the present invention will now be described. When either of the forward or rear portion of the key top 32 is pushed downward, the operating lever 25 is tilted about the pivot shaft 14 in unison with the motion of the key top 32. As a result, the driving rods 28 are slid along and tilt the movable contact pieces 24 such that an end of at least one of the movable contact pieces 24 abuts an associated fixed contact portion 20.

Figure 6:
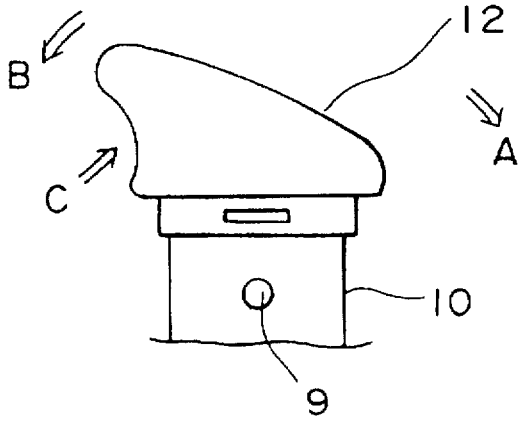
FIG. 6 is a schematic diagram for explaining switching operations.

When a pulling force is applied to the key top 32 in the direction C (see FIG. 6), the engaging protrusion 36 and the frame member 25 of the key top 32 remain tightly engaged to the wall 29 of the operating lever 25 such that the rotational moment caused by the pulling force is distributed throughout the entire engagement structure, so that the key top 32 and the operating lever 35 remain integrally connected with each other. Because the key top 32 remains integrally connected to the operating lever 25, the operating lever 25 turns about the pivot shaft and the movable contact pieces 24 abut the associated fixed contact portions 20.

According to the above described embodiment of the present invention, because the engaging protrusion 36 of the key top 32 is tightly fitted in the opening formed in the wall 29 of the operating lever 25 (that is, without leaving a space therebetween), the key top 32 will not become disengaged from the operating lever 25 even when a rotational moment is applied, thereby permitting the key top 32 to be securely mounted to the operating lever 25.

Further, because a portion of the key top 32 is fitted into the interior of the operating lever 25, a rotational moment developed in the key top 25 is not concentrated on the projections 30 and the holes 39, but is instead distributed over the entire surface of engagement between the key top 32 and the operating lever 25. Therefore, the key top 32 is not easily disengaged from the operating lever 25, as in the conventional key top mounting structure. As such, the key top mounting structure of the present invention may be used in both push-push type and push-pull type switches.

Consequently, it is possible to use the component parts of the key top mounting structure in various switch applications, thereby greatly reducing production costs by avoiding the need to produce separate key top mounting structures for both push-push and push-pull type switches.

While the present invention has been described with reference to a specific embodiment, the description is illustrative and should not be construed as limiting the scope of the invention. Various modifications and changes may occur to those skilled in the art without departing from the spirit and scope of the invention as defined by the appended claim.

What is claimed is:

1. A key top mounting structure for mounting a key top to a switch body of a vehicular switch, the key top mounting structure including:

an operating lever having a wall surrounding an opening, the operating lever including a pivot shaft for pivotally connecting the operating lever to the switch body;

a key top having an engaging protrusion and a frame member surrounding the engaging protrusion such that a gap having a predetermined width is provided between the engaging protrusion and the frame member;

a first stepped portion formed on an outer surface of the engaging protrusion, the first stepped portion extending in a longitudinal direction of the key top;

a hole formed in the frame member adjacent the first stepped portion;

a second stepped portion formed on an inner surface of the wall of the operating lever; and a projection formed on an outer surface of the wall of the operating lever, the projection being snap-coupled into the hole;

wherein the key top is engaged to the operating lever such that the wall of the operating lever is held in the gap located between the frame member and the engaging protrusion, and the engaging protrusion is received in the opening; and wherein the first stepped portion formed on the engaging protrusion abuts the second stepped portion formed on the wall.

2. The key top mounting structure of claim 1, wherein the engaging protrusion of the key top further is formed in a tapered shape which gradually diverges from an upper end of the engaging protrusion toward a lower free end thereof.

* * * * *